US008242862B2

(12) United States Patent
Akale

(10) Patent No.: US 8,242,862 B2
(45) Date of Patent: Aug. 14, 2012

(54) TUNABLE BANDPASS FILTER

(75) Inventor: Tamrat Akale, Azusa, CA (US)

(73) Assignee: Raytheon Company, Waltham, MA (US)

( * ) Notice: Subject to any disclaimer, the term of this patent is extended or adjusted under 35 U.S.C. 154(b) by 0 days.

(21) Appl. No.: 13/227,422

(22) Filed: Sep. 7, 2011

(65) Prior Publication Data

US 2011/0316653 A1 Dec. 29, 2011

Related U.S. Application Data

(62) Division of application No. 12/469,620, filed on May 20, 2009.

(51) Int. Cl.
*H01P 1/203* (2006.01)

(52) U.S. Cl. ..... 333/205; 333/204

(58) Field of Classification Search ..... 333/203–205, 333/235

See application file for complete search history.

(56) References Cited

U.S. PATENT DOCUMENTS

| | | | | |
|---|---|---|---|---|
| 3,104,362 | A | 9/1963 | Matthaei | |
| 3,343,069 | A * | 9/1967 | Tsuda | 307/424 |
| 3,646,413 | A | 2/1972 | Oomen | |
| 4,020,429 | A | 4/1977 | Bickley | |
| 4,999,596 | A * | 3/1991 | Nakatani et al. | 333/204 |
| 5,021,757 | A | 6/1991 | Kobayashi et al. | |
| 5,227,748 | A | 7/1993 | Sroka | |
| 5,442,330 | A | 8/1995 | Fuller et al. | |
| 6,252,476 | B1 | 6/2001 | Maloratsky | |
| 6,323,745 | B1 | 11/2001 | Toncich | |
| 6,525,630 | B1 | 2/2003 | Zhu et al. | |
| 6,717,491 | B2 | 4/2004 | Liang et al. | |
| 6,784,766 | B2 | 8/2004 | Allison et al. | |
| 7,057,481 | B2 * | 6/2006 | Yeh | 333/204 |
| 7,085,121 | B2 | 8/2006 | Lynch et al. | |
| 7,145,418 | B2 | 12/2006 | Akale et al. | |
| 7,161,791 | B2 | 1/2007 | Lynch et al. | |
| 7,400,488 | B2 | 7/2008 | Lynch et al. | |
| 7,446,994 | B2 | 11/2008 | Shimanouchi et al. | |

(Continued)

FOREIGN PATENT DOCUMENTS

EP 0 371 446 A2 6/1990

(Continued)

OTHER PUBLICATIONS

Koochakzadeh, et al., "Tunable Filters With Nonuniform Microstrip Coupled Lines", IEEE Microwave and Wireless Components Letters, vol. 18, No. 5, May 2008 (pp. 314-316).

(Continued)

*Primary Examiner* — Seungsook Ham
(74) *Attorney, Agent, or Firm* — Christie, Parker & Hale, LLP

(57) ABSTRACT

Tunable bandpass filters are provided. In one embodiment, the invention relates to a tunable bandpass filter including a dielectric substrate having a first surface opposite to a second surface, a conductive ground plane disposed on the first surface, a microstrip conductive trace pattern disposed on the second surface, the trace pattern defining a phase velocity compensation transmission line section including a series of spaced alternating T-shaped conductor portions, at least one varactor diode coupled to a first T-shaped conductor portion of the series of T-shaped conductor portions and to the conductive ground plane, and bias control circuitry coupled to the first T-shaped conductor portion, wherein the bias control circuitry is configured to control the at least one varactor diode.

21 Claims, 6 Drawing Sheets

U.S. PATENT DOCUMENTS

| | | | | |
|---|---|---|---|---|
| 2004/0075364 | A1 | 4/2004 | Mehta | |
| 2006/0125578 | A1 | 6/2006 | Akale et al. | |
| 2008/0129420 | A1 * | 6/2008 | Borisov et al. | 333/204 |

FOREIGN PATENT DOCUMENTS

| | | | |
|---|---|---|---|
| WO | WO 00/55936 | A1 | 9/2000 |
| WO | WO 03/028146 | A1 | 4/2003 |

OTHER PUBLICATIONS

European Search Report for European Application No. 10250906.4-1248, European Search Report dated Jul. 19, 2010 and mailed Jul. 26, 2010 (8 pgs.).

Fathelbab, et al., "Parallel-Coupled Line Filters with Enhanced Stopband Performances," IEEE Transactions on Microwave Theory and Techniques, Dec. 2005, pp. 3774-3781, vol. 53, No. 12.

* cited by examiner

TUNABLE BANDPASS FILTER

CROSS-REFERENCE TO RELATED APPLICATION(S)

This application is a divisional of U.S. patent application Ser. No. 12/469,620, filed May 20, 2009 and entitled "TUNABLE BANDPASS FILTER," the entire content of which is incorporated herein by reference.

FIELD OF THE INVENTION

The present invention relates generally to tunable filters. More specifically, the invention relates to tunable microwave bandpass filters for suppressing spurious signals at harmonics of the pass frequency.

BACKGROUND

Most microwave filters built using microstrip transmission lines are not effective at suppressing second, third and fourth harmonic signals. Traditionally, the way to solve this problem is to add a lowpass filter at the two ends of a bandpass filter. Physically, this makes the filter structure undesirably bigger. Electrically, using lowpass filters increases signal loss, and the suppression of the harmonics for the most part is not sufficiently effective.

Conventional microwave filters that are capable of suppressing such harmonics have been proposed. U.S. Pat. No. 7,145,418 to Akale et al., the entire content of which is incorporated herein by reference, describes an edge coupled bandpass filter capable of suppressing harmonics. However, some filter applications can require use of different pass frequencies. One way to meet this need is to use a separate filter for each pass frequency. However, the use of multiple filters can be inefficient and expensive. Therefore, a tunable microwave bandpass filter is desirable.

SUMMARY OF THE INVENTION

Aspects of the invention relate to a tunable bandpass filter. In one embodiment, the invention relates to a tunable bandpass filter including a dielectric substrate having a first surface opposite to a second surface, a conductive ground plane disposed on the first surface, a microstrip conductive trace pattern disposed on the second surface, the trace pattern defining a phase velocity compensation transmission line section including a series of spaced alternating T-shaped conductor portions, at least one varactor diode coupled to a first T-shaped conductor portion of the series of T-shaped conductor portions and to the conductive ground plane, and bias control circuitry coupled to the first T-shaped conductor portion, wherein the bias control circuitry is configured to control the at least one varactor diode.

In another embodiment, the invention relates to a tunable bandpass filter including a dielectric substrate having a first surface opposite to a second surface, a conductive ground plane disposed on the first surface, a microstrip conductive trace pattern disposed on the second surface, the trace pattern defining a phase velocity compensation transmission line section including a series of spaced alternating T-shaped conductor portions, a tunable substrate disposed at a preselected distance above the trace pattern, a piezoelectric transducer attached to the tunable substrate, wherein the tunable substrate is configured to move when a voltage is applied to the piezoelectric transducer, wherein a movement of the tunable substrate results in a change to an effective dielectric constant of the filter.

In yet another embodiment, the invention relates to a tunable bandpass filter including a dielectric substrate having a first surface opposite to a second surface, a conductive ground plane disposed on the first surface, a conductive trace pattern disposed on the second surface, the trace pattern defining a phase velocity compensation transmission line section including a series of spaced alternating T-shaped conductor portions, and a means for adjusting an impedance of the conductive trace pattern.

DETAILED DESCRIPTION

Figure 1:
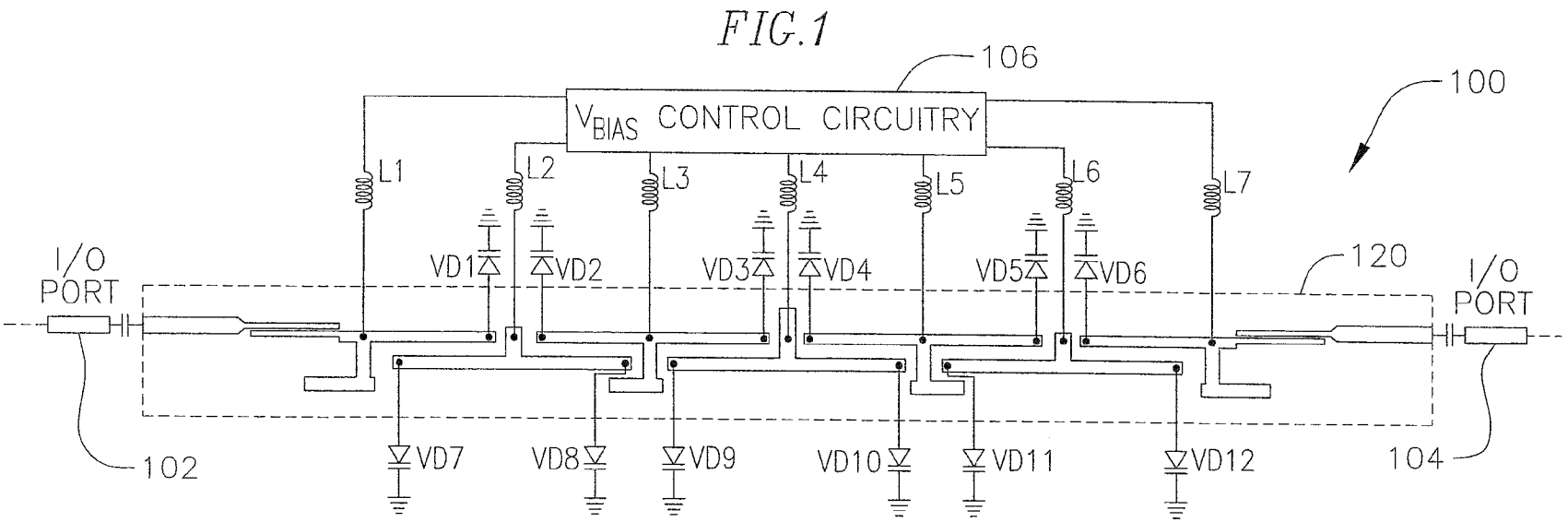
FIG. 1 is a schematic diagram illustrating a tunable bandpass filter including a microstrip trace pattern and a number of variable capacitors or varactors for tuning the filter in accordance with one embodiment of the present invention.

Referring now to the drawings, embodiments of tunable bandpass filters are illustrated. In several embodiments, the bandpass filters are tuned by controlling variable capacitors coupled to conductive segments of a conductive trace pattern. The conductive segments of the conductive trace pattern are formed in particular shapes designed to compensate for mismatch in the phase velocities for even and odd modes of signal propagation. In some embodiments, the conductive segments include T-shaped segments and TL-shaped segments arranged in a staggered offset manner. In other embodiments, the conductive segments include only T-shaped segments arranged in the staggered offset manner.

In some embodiments, the bandpass filters are tuned by controlling a piezoelectric transducer coupled to a tuning substrate in close proximity to a conductive trace pattern on a filter substrate. Movement of the tuning substrate in close proximity to the conductive trace pattern changes the effective dielectric constant of the filter substrate, thereby tuning the filter.

Embodiments of the tunable filters provide good suppression of harmonics, including, for example first, second, third and fourth order harmonics. The tunable filters can further provide very low loss, high return loss and a wide tuning range. Such tunable filters have a number of applications.

While not bound by any particular theory, in an edge coupled filter fabricated in a planar transmission line medium, such as a microstrip or stripline transmission line, energy is propagated through the filter via edge-coupled resonator elements or conductor strips. Harmonics in the filter response appear due to the mismatch in phase velocities of the even and odd modes. In microstrip coupled lines, the odd mode travels faster than the even mode. Also, the odd mode tends to travel along the outer edges of the microstrip coupled lines or conductor strips, while the even mode tends to travel near the center. In several embodiments, to suppress the harmonics of the filter, means for equalizing the even and odd mode electrical lengths and for adjusting the filter pass frequency are provided.

FIG. 1 is a schematic diagram illustrating a tunable bandpass filter 100 including a microstrip trace pattern 120 and a number of variable capacitors or varactors for tuning the filter in accordance with one embodiment of the present invention. The microstrip trace pattern 120 is coupled by capacitors to input/output (I/O) ports 102 and 104.

Figure 2:
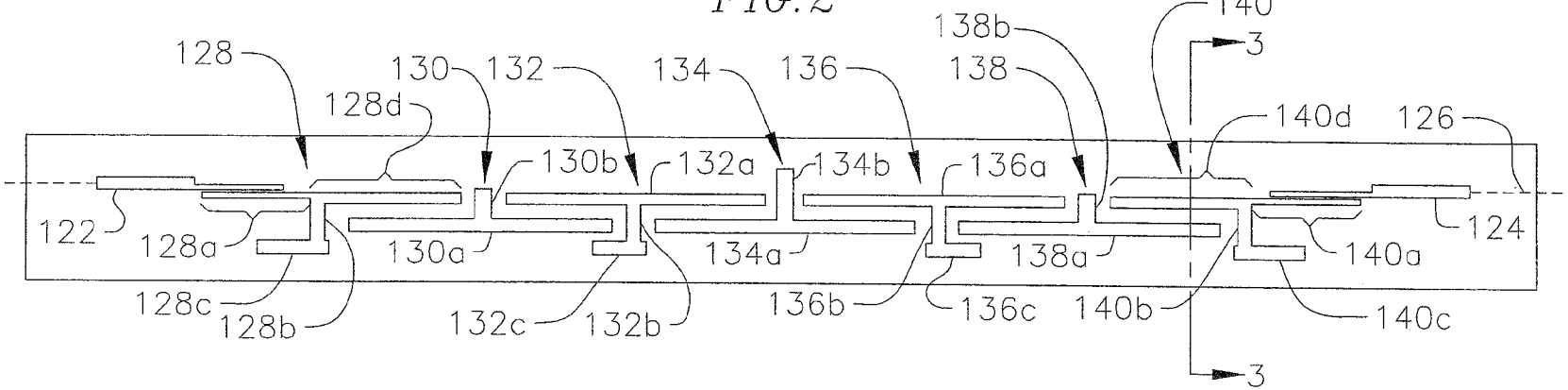
FIG. 2 is a top view of the microstrip trace pattern of FIG. 1.

FIG. 2 is a top view of the microstrip trace pattern of FIG. 1. The trace pattern 120 includes multiple trace segments or portions (128-140), where each segment is coupled by an inductor (L1-L7), acting as a radio frequency (RF) choke, to bias voltage control circuitry 106. The trace segments (128-140) are also coupled by one or more varactor diodes (VD1-VD12) to ground at preselected points along the trace segments. The bias voltage control circuitry 106 controls the direct current (DC) bias of each of the trace segments (128-140) of the trace pattern 120. By adjusting the bias voltage at the trace segments (128-140), the filter can be tuned for preselected pass frequencies and preselected ranges.

The trace pattern 120 includes a series of alternating conductor sections or trace segments (128-140), arranged in a staggered offset manner relative to a filter axis 126. The conductor sections are edge-coupled at an RF operating frequency band. The spatial separation of the conductor sections provides DC isolation. Each trace segment (128-140) includes a coupled line portion which is adjacent to a corresponding coupled line portion of an adjacent conductor section. For example, trace segment 132 includes line segment 132*a* which overlaps with line segment 134*a* of trace segment 134. In one embodiment, these overlapping line segments are approximately quarter wavelength in length, at an operating frequency.

In further detail, the trace pattern 120 includes a first I/O section 122, a second I/O section 124, three T-shaped trace segments (130, 134, 138), four TL-shaped trace segments (128, 132, 136, 140) and the filter axis 126. The T-shaped segments and TL-shaped segments each have a primary parallel leg portion oriented along the filter axis, and a transverse stub oriented perpendicular to and bisecting the parallel leg portion. The TL-shaped segments further include a secondary parallel leg portion, shorter than the primary parallel leg portion, disposed at the end of the transverse stub opposite to the stub end that bisects the primary parallel leg portion. The transverse stub and the secondary parallel leg portion approximately form an L-shape and the transverse stub and the primary parallel section approximately form a T-shape, effectively forming a TL-shape in combination.

For example, TL-shaped segment 128 includes a primary parallel leg portion, having thin section 128*a* and thick section 128*d* along the filter axis 126, a transverse stub 128*b* and a secondary parallel leg portion 128*c*. The thin section 128*a* is disposed extremely close to a thin section of the first I/O section 122 for coupling purposes. Similarly, TL-shaped segment 140 includes a primary parallel leg portion, having thin section 140*a* and thick section 140*d* along the filter axis 126, a transverse stub 140*b* and a secondary parallel leg portion 140*c*. The thin section 140*a* is disposed extremely close to a thin section of the first I/O section 124.

T-shaped segment 130 includes parallel leg portion 130*a* and transverse stub portion 130*b*. Similarly, T-shaped segment 134 includes parallel leg portion 134*a* and transverse stub portion 134*b*. Similarly, T-shaped segment 138 includes parallel leg portion 138*a* and transverse stub portion 138*b*.

TL-shaped segment 132 includes primary parallel leg portion 132*a*, transverse stub 132*b*, and secondary parallel leg portion 132*c*. Similarly, TL-shaped segment 136 includes primary parallel leg portion 136*a*, transverse stub 136*b*, and secondary parallel leg portion 136*c*. The secondary parallel leg portion 136*c* is shorter in length than that of the secondary parallel leg portion 140*c* of TL-shaped segment 140. The transverse stub 136*b* includes ends that terminate at the primary parallel leg portion 136*a* and the secondary parallel leg portion 136*c*, thereby forming the TL-shaped segment 136. The transverse stub 136*b* also abuts the secondary parallel leg portion 136*c* at a point between the ends of the secondary parallel leg portion 136*c*, which has a rectangular shape.

The bias voltage control circuitry 106 controls the DC voltage bias of each T-shaped segment and each TL-shaped segment. Each T-shaped segment and each TL-shaped segment is coupled to one or more varactor diodes. By changing the DC bias at each segment, the varactor diodes modify the capacitance to ground thereby changing the impedance seen by signals traveling along the trace pattern and the frequency response of the tunable filter. In some circumstances, the impedance of the trace pattern can be defined as including the impedance seen by signals traveling along the trace pattern. The characteristics of the frequency response that can be adjusted or tuned include the center frequency along with the overall range of the filter. For example, the center frequency will move up or down as a function of the applied bias voltage.

The bias voltage control circuitry can be implemented using any combination of processors, memory, discrete logic components, data buses and/or other processing elements that share information. In some embodiments, a number of jumpers or toggle switches can be used to enable a user to make adjustments to the frequency response characteristics of the filter.

The filter response can be symmetric about its center frequency (see for example in FIG. 7); depending on the length of the quarter wavelength coupled line, the transverse stub lengths may be optimized, which may result in different stub lengths. Since the odd mode tends to travel along the outer edges of the coupled lines or conductor strips, while the even mode tends to travel near the center, the T-shaped and TL-shaped sections add transmission line length which is traveled by the odd mode, but not the even mode. As a result, the odd and even mode components propagating along the trace pattern arrive at the output port in phase. In a number of embodiments, the T-shaped sections or conductor portions are defined as including the TL-shaped sections.

In the filter embodiments illustrated in FIG. 1 and FIG. 2, the filter pattern is symmetric about a line bisecting the filter axis. In addition, the filter components, such as the varactor diodes and inductors, are placed at symmetric locations about the bisecting line. In some embodiments, the values of such components are matched at symmetric locations about the bisecting line. Such symmetry can be important to providing a favorable frequency response. In other embodiments, other symmetrical configurations can be used. In some embodiments, non-symmetrical configurations can be used.

Figure 3:
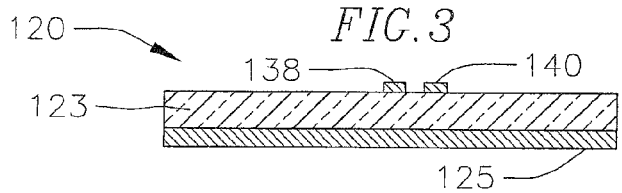
FIG. 3 is a cross-sectional side view of the microstrip bandpass filter taken along the section 3-3 of FIG. 2.

FIG. 3 is a cross-sectional side view of the microstrip bandpass filter 120 taken along the section 3-3 of FIG. 2. The filter embodiments of FIGS. 1, 2 and 3 may be constructed in microstrip. In other embodiments, the tunable filter can be constructed using other suitable materials. The filter includes a substantially planar dielectric substrate 123, for example, a substrate such as alumina or duroid having a substrate height h. A conductive ground plane layer 125 is formed on one surface of the dielectric substrate, here the bottom surface of the substrate 123. The conductive microstrip trace pattern is formed on a opposite substrate surface opposite the ground plane, in this example the top surface (e.g., illustrated portion includes portions of segments 138 and 140). The trace pattern forms the conductor sections (128-140) and the I/O ports (122, 124). In one embodiment, the trace pattern may be fabricated using photo lithographic techniques. In several embodiments, the trace pattern and ground plane can be implemented using gold, copper or another suitable conductive material. In some embodiments, the material for the trace pattern and ground plane is selected based on the substrate material.

The phase velocity mismatches of the even and odd modes may be compensated by extending the odd mode traveling path. In one embodiment of the filter structure, the alternating T-shaped and TL-shaped portions of the filter provide the compensation. In a microstrip coupled line, the odd mode is faster and tends to travel on the edges of the line, while the even mode is slower and travels along the center of the coupled lines. The filter architecture illustrated in FIG. 1 compensates for the mismatch of phase velocities of the even and odd modes in the filter structure by periodically introducing stubs and secondary parallel legs, and by adjusting the electrical length of the quarter wave coupled line sections in the filter. In several embodiments, most of the phase compensation is provided by the T-shaped or TL-shaped portions. Some phase compensation may be provided by varying the lengths of the coupled lines away from the nominal quarter wavelength, for example, by optimization.

In the embodiment illustrated in FIG. 1, seven inductors are used. In other embodiments, more than or less than seven inductors. In the embodiment illustrated in FIG. 1, an inductor is coupled to each T-shaped or TL-shaped segment. In other embodiments, an inductor may not be coupled to each segment. In the embodiment illustrated in FIG. 1, twelve varactor diodes are coupled to specific areas of the T-shaped and TL-shaped segments. In other embodiments, more than or less than twelve varactor diodes can be coupled at various points along the segments.

In the embodiment illustrated in FIG. 1, a combination of seven T-shaped and TL-shaped segments are arranged in a staggered offset manner relative to the filter axis. In other embodiments, more than or less than seven T-shaped and TL-shaped segments can be arranged in different configurations arranged to delay the odd mode propagation for equalizing phase velocity across the tunable filter. In other embodiments, the varactor diodes can be replaced with other components capable of modifying the capacitance of the trace pattern or segments thereof. In some embodiments, the varactor diodes can be replaced with other components capable of providing impedance control. In other embodiments, other suitably shaped segments can be used. In a number of embodiments, the filter pattern is symmetric about a line bisecting the filter axis. In such case, the symmetry can be important to a desirable frequency response.

Figure 4:
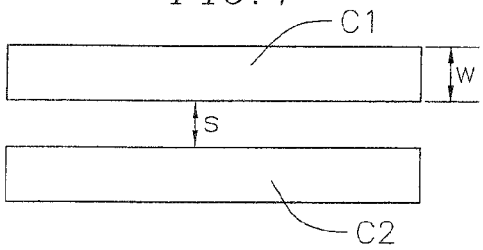
FIG. 4 is a top view of an enlarged portion of a bandpass filter trace pattern, showing overlapped, edge-coupled conductor strips, in accordance with one embodiment of the present invention.
Figure 5:
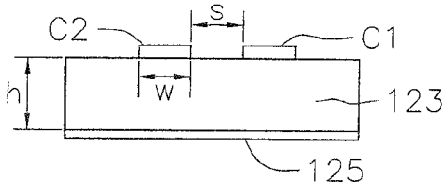
FIG. 5 is a diagrammatic end view of the bandpass filter of FIG. 4.
Figure 6:
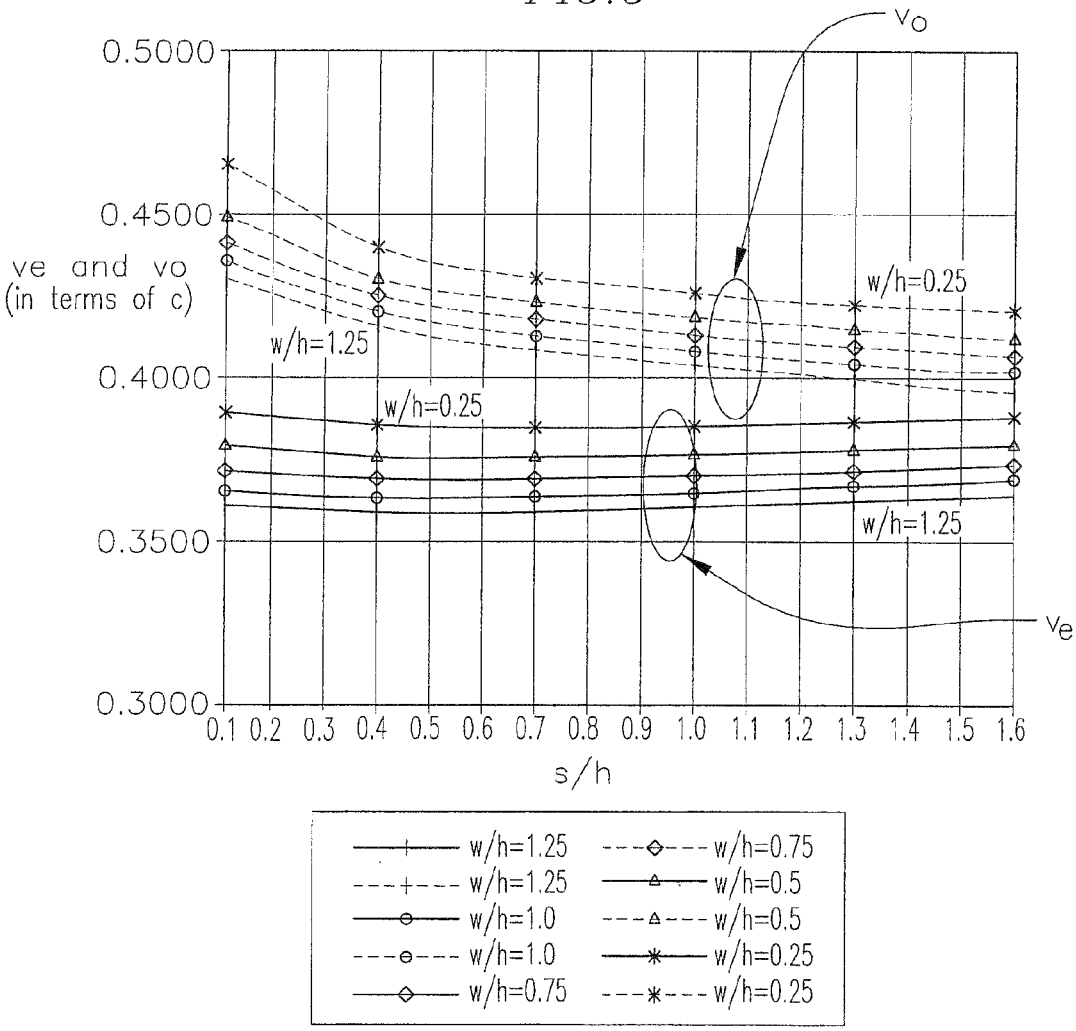
FIG. 6 is a graph depicting velocities of even and odd modes of propagation as a function of filter parameters, in accordance with one embodiment of the present invention.

FIGS. 4, 5, and 6 depict how variations of the design parameters for a microstrip transmission line embodiment affect the phase velocities of the even and odd modes propagating in an edge coupled filter. FIG. 4 is a top view of an enlarged portion of a bandpass filter trace pattern, showing overlapped, edge-coupled conductor strips, in accordance with one embodiment of the present invention. The filter trace pattern includes edge-coupled conductor strips C1 and C2, having width w, formed as microstrip conductors on a surface of a dielectric substrate 123. The conductor strips C1 and C2 are arranged in parallel, and are spaced apart by a distance s. As depicted in the end view, FIG. 5, the substrate 123 has a height h. FIG. 6 is a graph showing calculated phase velocities for the even mode (ve) and odd mode (vo) as a function of the ratio s/h, and for different ratios w/h.

Figure 7:
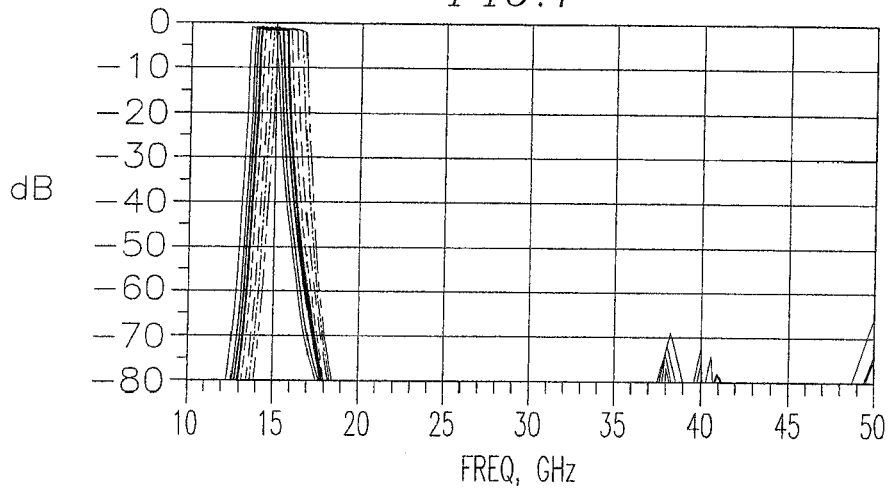
FIG. 7 is a graph illustrating in a wide band view the performance of the tunable bandpass filter of FIG. 1 at different settings of the filter.

FIG. 7 is a graph illustrating in a wide band view the performance of the tunable bandpass filter of FIG. 1 at different settings of the filter. In several embodiments, a simulation of the tunable filter 120 attenuates the second and third order harmonics as shown in FIG. 7 with very good out-of-band rejection. In some circumstances, embodiments of the tunable filter even attenuate fourth order harmonics. The graph of FIG. 7 further illustrates attenuation as a function of frequency for different settings of an exemplary 15 GHz tunable filter adjusted for eight different passbands centered at frequencies from approximately 14 to 16 GHz. In the graph illustrated in FIG. 7, there are effectively no spurious signals up to 50 GHz. The miscellaneous signals seen at 37-41 GHz and 48-50 GHz are below the noise floor.

In several embodiments, the microstrip filters exhibit very low filter loss with very high out-of-band rejection characteristics. In a number of embodiments, the microstrip filters exhibit a good linear phase for over 80% of the filter bandwidth, and harmonics in the insertion loss characteristic are effectively suppressed.

Figure 8:
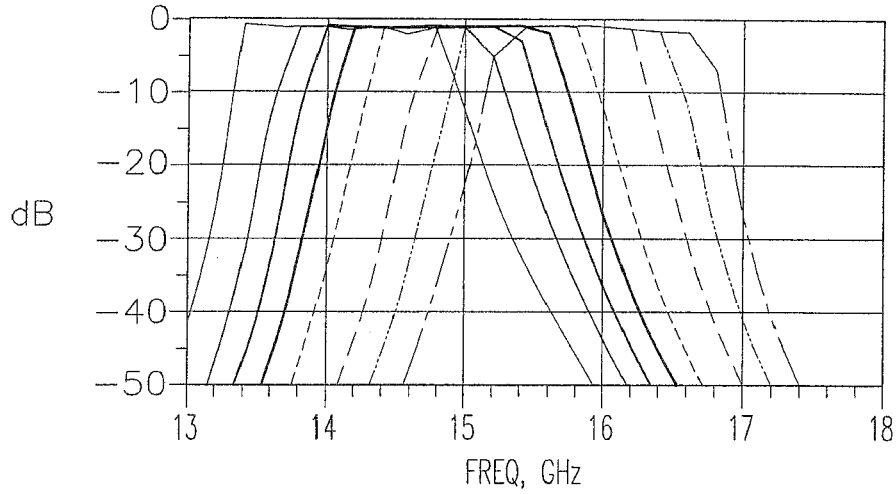
FIG. 8 is a graph illustrating in a close up view the insertion loss of the tunable bandpass filter of FIG. 1 at different settings of the filter.

FIG. 8 is a graph illustrating in a close up view the insertion loss of the tunable bandpass filter of FIG. 1 at different settings of the filter. Unlike some conventional filters, the performance characteristics of the illustrated tunable bandpass filter show little degradation from one filter setting to the next.

Figure 9:
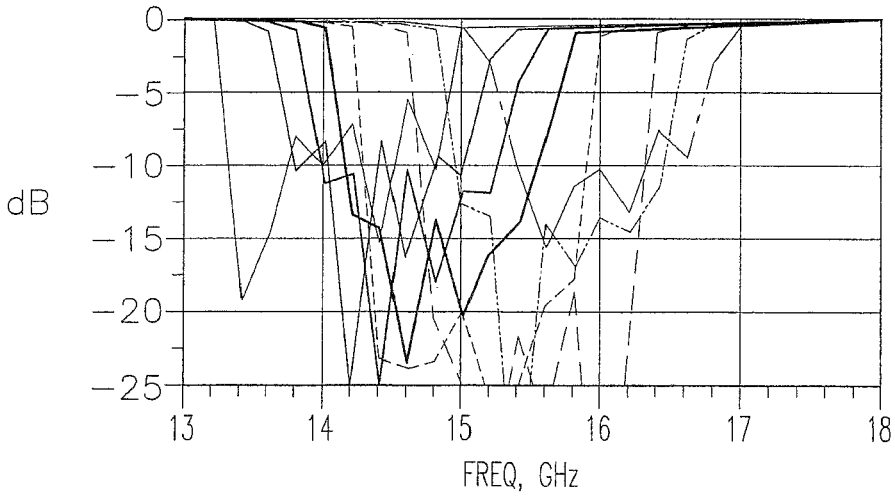
FIG. 9 is a graph illustrating in a close up view the return loss of the tunable bandpass filter of FIG. 1 at different settings of the filter.

FIG. 9 is a graph illustrating in a close up view the return loss of the tunable bandpass filter of FIG. 1 at different settings of the filter.

Figure 10:
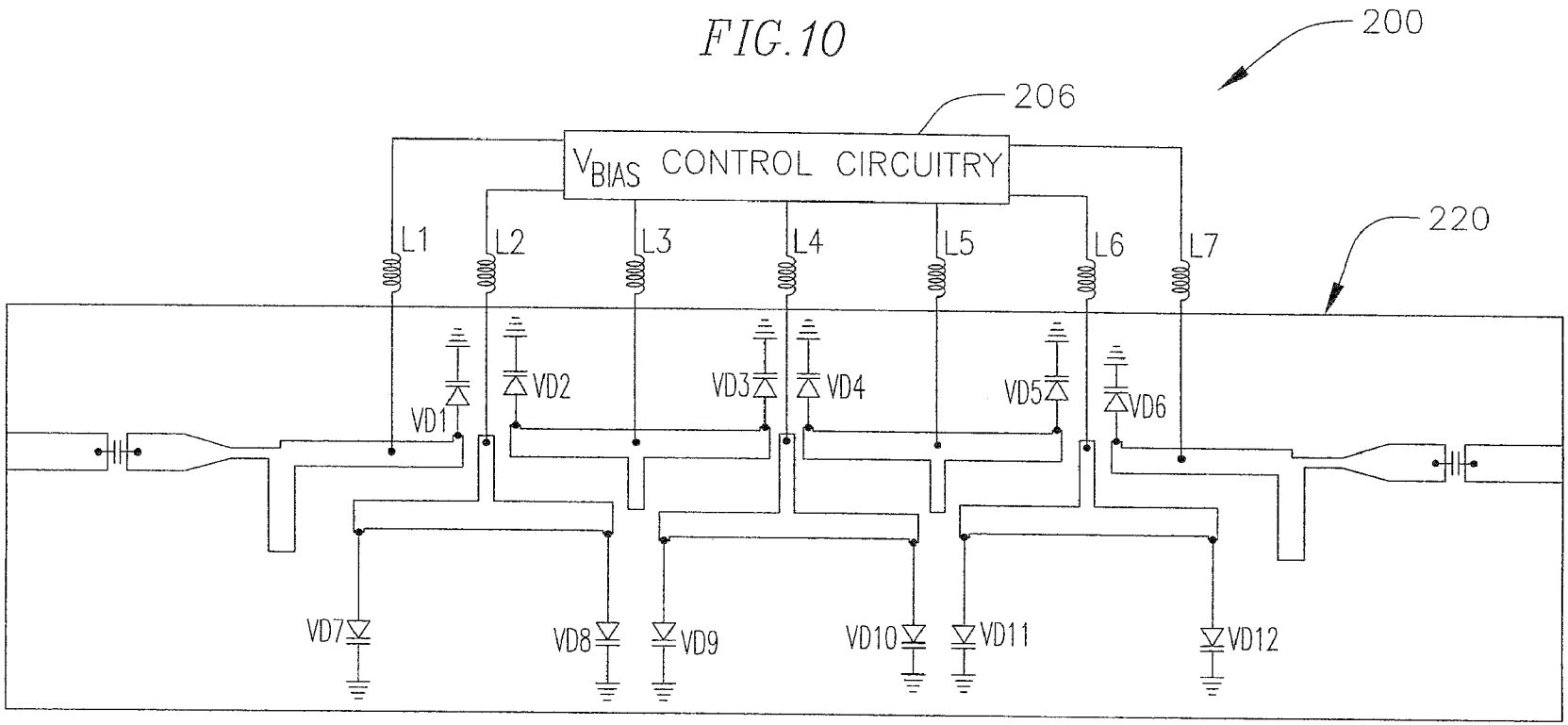
FIG. 10 is a schematic diagram illustrating a tunable bandpass filter including an alternative microstrip trace pattern and a number of variable capacitors or varactors for tuning the filter in accordance with one embodiment of the present invention.

FIG. 10 is a schematic diagram illustrating a tunable bandpass filter 200 including an alternative microstrip trace pattern 220 and a number of variable capacitors or varactors (VD1-VD12) for tuning the filter in accordance with one embodiment of the present invention.

The trace pattern 220 includes multiple trace segments, where each segment is coupled by an inductor (L1-L7), acting as a radio frequency (RF) choke, to a bias voltage control circuitry 206. The trace segments are also coupled by one or more varactor diodes (VD1-VD12) to ground. The bias voltage control circuitry 206 controls the direct current (DC) bias of the segments of the trace pattern 220. By adjusting the bias voltage at the trace segments, the filter can be tuned for preselected pass frequencies and preselected ranges.

As compared to the tunable filter of FIG. 1, the structure of the alternative microstrip trace pattern 220 includes similar T-shaped segments/sections arranged in a staggered offset manner relative to a filter axis. The conductor sections are edge-coupled at an RF operating frequency band. The spatial separation of the conductor sections provides DC isolation.

However, in the embodiment illustrated in FIG. 10, only T-shaped sections are arranged in the staggered offset manner. This microstrip trace pattern can provide sufficient performance characteristics for a number of applications. However, in a number of embodiments, the performance characteristics, such as range of frequency response and range of tunability, of the tunable filter of FIG. 1 are superior to those of the tunable filter of FIG. 10. In some applications, however, the tunable filter of FIG. 10 can be preferred.

In a number of aspects, the tunable filter of FIG. 10 can operate as described above for the tunable filter of FIG. 1.

Figure 11:
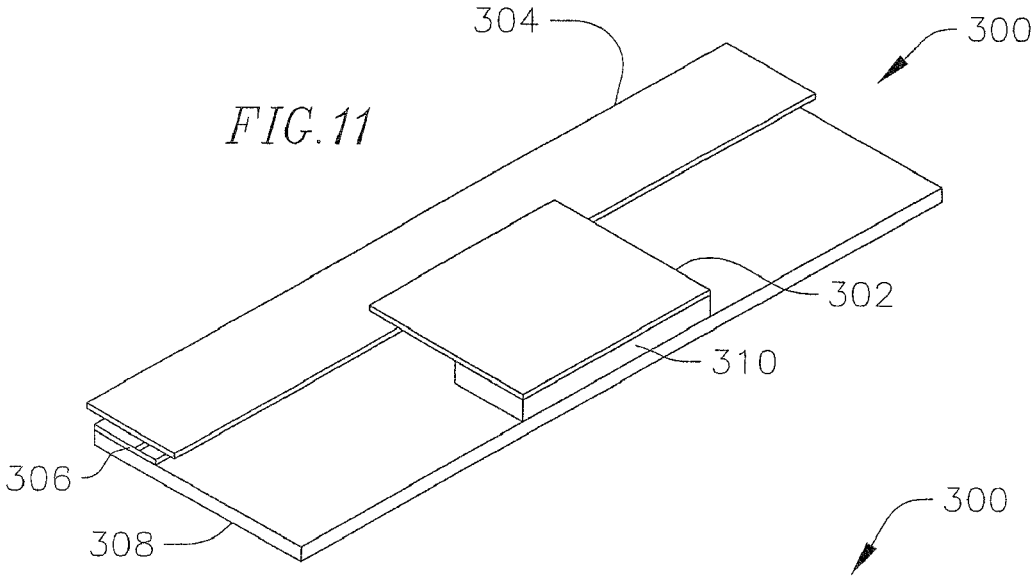
FIG. 11 is a perspective view of another embodiment of a bandpass filter including a piezoelectric transducer and a tuning substrate for tuning the filter.
Figure 12:
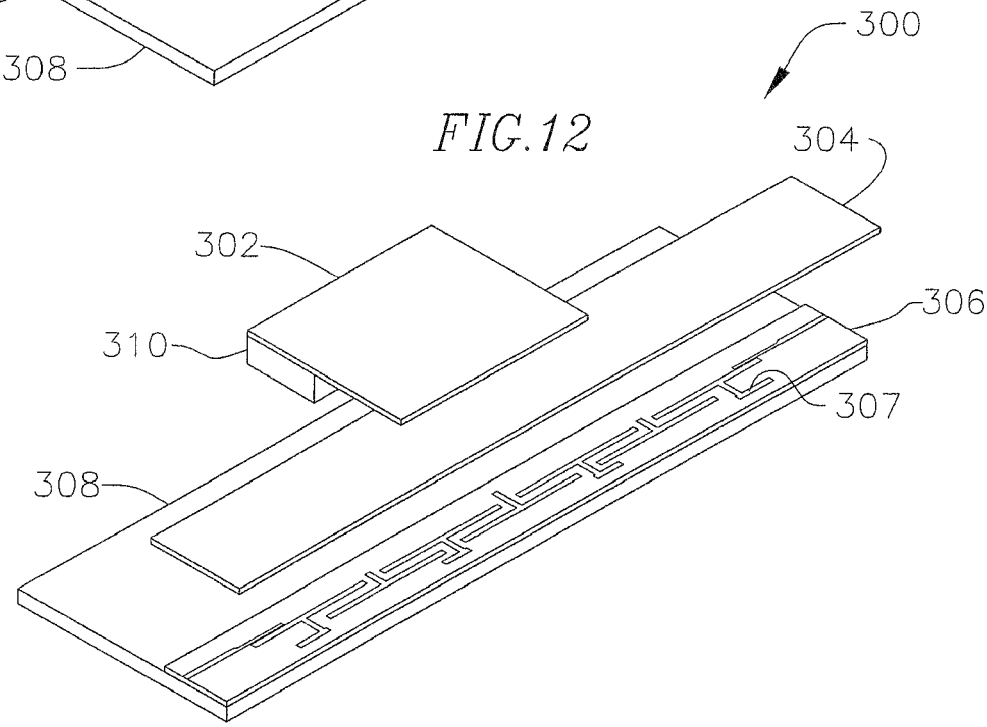
FIG. 12 is an exploded perspective view of the tunable bandpass filter of FIG. 11 shown from the opposite perspective.
Figure 13:
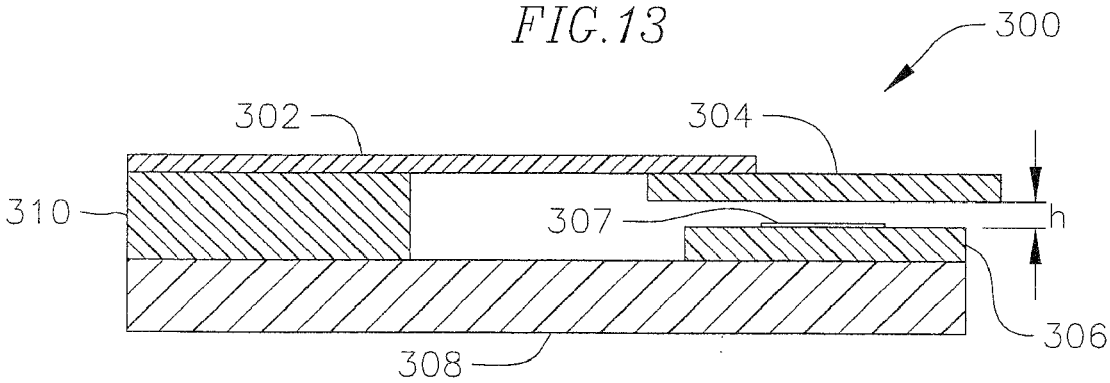
FIG. 13 is a side view of the tunable bandpass filter of FIG. 11.

FIG. 11 is a perspective view of another embodiment of a tunable bandpass filter 300 including a piezoelectric transducer 302 and a tuning substrate 304 for tuning the filter. FIG. 12 is an exploded perspective view of the tunable bandpass filter 300 of FIG. 11 from the opposite perspective. FIG. 13 is a side view of the tunable bandpass filter 300 of FIG. 11. The tunable filter 300 further includes a filter substrate 306, a filter trace pattern 307, a carrier 308, and a support 310. The filter substrate 306 is disposed on a top surface of the carrier 308. The filter trace pattern 307 is disposed on a top surface of the filter substrate 306. A bottom surface of the support 310 is secured to the top surface of carrier 308. A first end of the piezoelectric transducer 304 is attached to a top surface of the support 310. A second end of the piezoelectric transducer 304 is attached to the tuning substrate 304. A preselected distance h separates the bottom surface of the tuning substrate 304 from the filter trace pattern 307 disposed on the filter substrate 306 (see FIG. 13).

In operation, a voltage is applied to the piezoelectric transducer causing up and down movement of the tuning substrate attached to the piezoelectric transducer. The movement of the tuning substrate changes the preselected distance h and the effective dielectric constant of the filter trace pattern. By controlling the effective dielectric constant or impedance seen by signals traveling along the filter trace pattern, the filter can be tuned as desired. In some circumstances, the impedance of the filter trace pattern can be defined as including the impedance seen by signals traveling along the filter trace pattern.

In one embodiment, the piezoelectric transducer is made of lead, zirconate and/or titanate. In other embodiments, the piezoelectric transducer can be made of other suitable materials. For example, in one embodiment, the piezoelectric transducer can be made of any electro-mechanical material where movement of the material can be controlled by a software program.

In the embodiment illustrated in FIGS. 11 and 12, the filter trace pattern s extremely similar to the trace pattern of FIGS. 1 and 2. In another embodiment, the filter trace pattern of FIG. 10 can be used. In other embodiments, other suitable trace patterns can be used.

As for performance, the tunable filter illustrated in FIGS. 11-13 can provide very good tuning range while effectively eliminating spurious noise.

Figure 14:
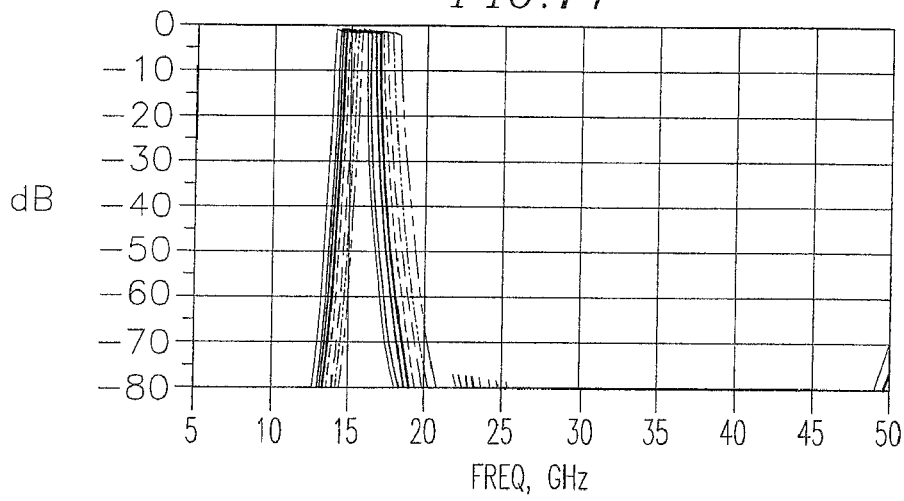
FIG. 14 is a graph illustrating in a wide band view the performance of the tunable bandpass filter of FIG. 11 at different settings of the filter.

FIG. 14 is a graph illustrating in a wide band view the performance of the tunable bandpass filter of FIG. 11 at different settings of the filter. In several embodiments, a simulation of the tunable filter of FIG. 11 attenuates the second and third order harmonics as shown in FIG. 14 with very good out-of-band rejection. In some circumstances, embodiments of the tunable filter even attenuate fourth order harmonics. The graph of FIG. 14 illustrates attenuation as a function of frequency for different settings of an exemplary 15 GHz tunable filter adjusted for eight passbands centered at frequencies from approximately 14 to 16 GHz. In the graph illustrated in FIG. 14, there are effectively no spurious signals up to 50 GHz. The miscellaneous signals seen at 37-41 GHz and 48-50 GHz are below the noise floor.

In several embodiments, the microstrip filters exhibit very low filter loss with very high out-of-band rejection characteristics. In a number of embodiments, the microstrip filters exhibit a good linear phase for over 80% of the filter bandwidth, and harmonics in the insertion loss characteristic are effectively suppressed.

Figure 15:
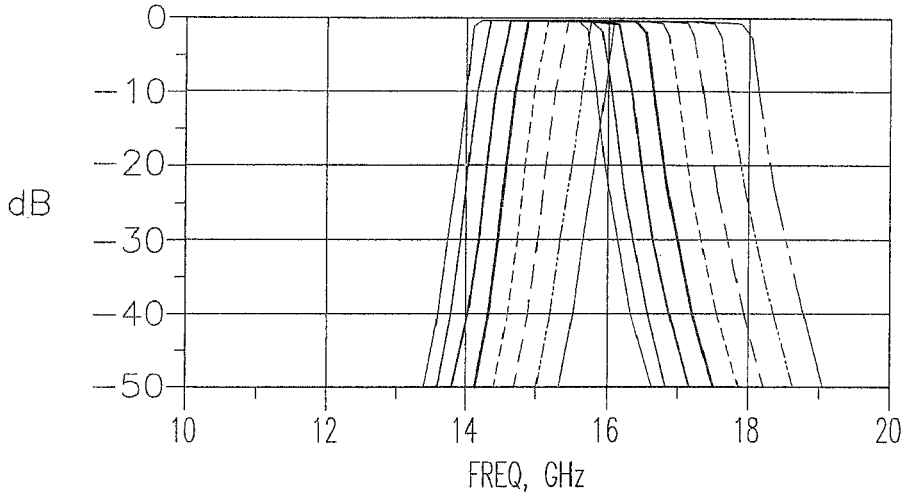
FIG. 15 is a graph illustrating in a close up view the insertion loss of the tunable bandpass filter of FIG. 11 at different settings of the filter.

FIG. 15 is a graph illustrating in a close up view the insertion loss of the tunable bandpass filter of FIG. 11 at different settings of the filter. Unlike some conventional filters, the performance characteristics of the illustrated tunable bandpass filter show minimal or non-existent degradation from one filter setting to the next.

Figure 16:
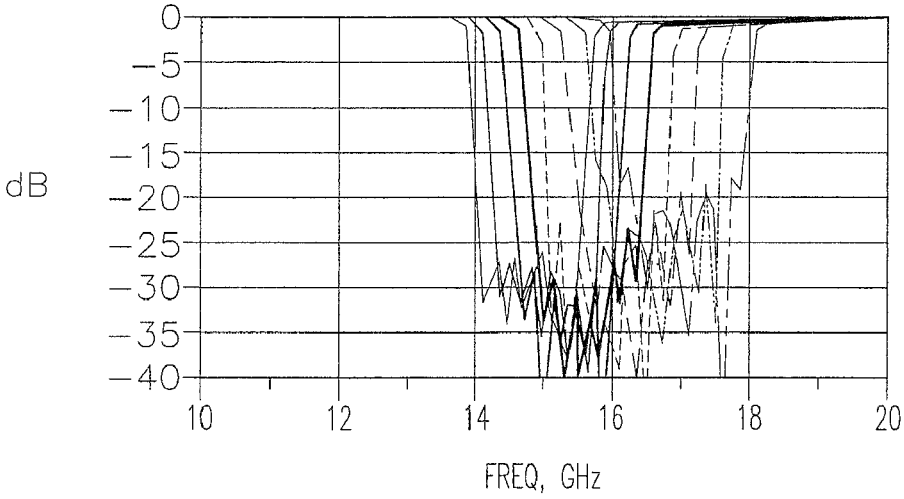
FIG. 16 is a graph illustrating in a close up view the return loss of the tunable bandpass filter of FIG. 11 at different settings of the filter.

FIG. 16 is a graph illustrating in a close up view the return loss of the tunable bandpass filter of FIG. 11 at different settings of the filter.

In comparing the tunable filters of FIG. 1 and FIG. 11, the filter of FIG. 1 has some performance degradation in bandwidth and insertion loss and has a comparatively limited tuning range while effectively eliminating spurious noise. On the other hand, the filter of FIG. 11 has very good tuning range with no spurious noise, but the applied voltage required to operate the piezoelectric transducer can be relatively high. Each tunable filter can have relative advantages that suit various applications. For example, for the filter illustrated in FIG. 1, the varactor diode tenability is generally okay, however the tenability range is less than that of the filter of FIG. 11.

In many embodiments, the tunable filters are very compact, resulting in significant reductions in size and weight as compared to most microwave integrated circuits which utilize multiple filters. In some embodiments, the filter architecture or trace pattern can be implemented in a transmission line type other than microstrip (e.g., in stripline or coplanar waveguide).

While the above description contains many specific embodiments of the invention, these should not be construed as limitations on the scope of the invention, but rather as examples of specific embodiments thereof. Accordingly, the scope of the invention should be determined not by the embodiments illustrated, but by the appended claims and their equivalents.

What is claimed is:

1. A tunable bandpass filter comprising:

a dielectric substrate having a first surface opposite to a second surface;

a conductive ground plane disposed on the first surface;

a conductive trace pattern disposed on the second surface, the trace pattern defining a phase velocity compensation transmission line section comprising a series of spaced T-shaped conductor portions alternating with at least one TL-shaped conductor portion;

at least one varactor diode coupled to a first T-shaped conductor portion of the series of T-shaped conductor portions and to the conductive ground plane; and bias control circuitry coupled to the first T-shaped conductor portion, wherein the bias control circuitry is configured to control the at least one varactor diode, wherein the at least one TL-shaped conductor portion comprises a parallel leg, a secondary parallel leg, and a transverse stub positioned between the parallel leg and the secondary parallel leg, wherein the parallel leg and the secondary parallel leg are each oriented parallel to a filter axis, and wherein the secondary parallel leg consists of a rectangular shaped leg.

2. The tunable bandpass filter of claim 1:

wherein the transverse stub is configured to provide a transmission line length traveled by an odd mode of energy propagation and not by an even mode of energy propagation, and wherein the phase velocity compensation transmission line section is configured to provide phase compensation for odd mode energy propagation at a different rate than even mode energy propagation.

3. The tunable bandpass filter of claim 1, wherein the phase velocity compensation transmission line section provides suppression of at least second and third order harmonics of a filter response.

4. The tunable bandpass filter of claim 1, wherein the transverse stub and the secondary parallel leg are configured to provide a transmission line length traveled by an odd mode of energy propagation and not by an even mode of energy propagation, and wherein the phase velocity compensation transmission line section is configured to provide phase compensation for odd mode energy propagation at a different rate than even mode energy propagation.

5. The tunable bandpass filter of claim 1, wherein the T-shaped conductor portions each comprise:

a parallel leg oriented parallel to a filter axis; and a transverse stub having a first end coupled to the T-shaped conductor parallel leg, the T-shaped conductor transverse stub oriented perpendicular to the filter axis, wherein the T-shaped conductor transverse stub bisects the T-shaped conductor parallel leg.

6. The tunable bandpass filter of claim 1, further comprising:

a first varactor diode coupled to the first T-shaped conductor portion of the T-shaped conductor portions and to the conductive ground plane;

a second varactor diode coupled to a second T-shaped conductor portion of the T-shaped conductor portions and to the conductive ground plane; and the bias control circuitry coupled to the first T-shaped conductor portion and the second T-shaped conductor portion, wherein the bias control circuitry is configured to independently control a first voltage provided to the first varactor diode and a second voltage provided to the second varactor diode.

7. The tunable bandpass filter of claim 1, further comprising:

a first varactor diode coupled to the first T-shaped conductor portion of the T-shaped conductor portions and to the conductive ground plane;

a second varactor diode coupled to the first T-shaped conductor portion of the T-shaped conductor portions and to the conductive ground plane; and the bias control circuitry coupled to the first T-shaped conductor portion, wherein the bias control circuitry is configured to control a voltage provided to the first varactor diode and the second varactor diode.

8. The tunable bandpass filter of claim 1, further comprising a first inductor coupled in series between the first T-shaped conductor portion and the bias control circuitry.

9. The tunable bandpass filter of claim 1, wherein the bias control circuitry is configured to change a frequency response of the filter by controlling the at least one varactor diode.

10. The tunable bandpass filter of claim 1, further comprising:

a first input/output port at one end of the trace pattern;

a second input/output port at an opposite end of the trace pattern;

a filter axis line extending from the first port to the second port; and a dividing axis bisecting the filter axis line, wherein the trace pattern is symmetric about the dividing axis.

11. The tunable bandpass filter of claim 1, wherein the conductive trace pattern comprises a microstrip conductive trace pattern.

12. The tunable bandpass filter of claim 1, wherein the at least one TL-shaped conductor portion comprises:

a first TL-shaped conductor portion positioned at an end of the conductive trace pattern and a second TL-shaped conductor portion, wherein a length of the secondary parallel leg of the first TL-shaped conductor portion is greater than a length of the secondary parallel leg of the second TL-shaped conductor portion.

13. A tunable bandpass filter comprising:

a dielectric substrate having a first surface opposite to a second surface;

a conductive ground plane disposed on the first surface;

a conductive trace pattern disposed on the second surface, the trace pattern defining a phase velocity compensation transmission line section comprising a series of spaced T-shaped conductor portions alternating with at least one TL-shaped conductor portion comprising a parallel leg, a secondary parallel leg, and a transverse stub positioned between the parallel leg and the secondary parallel leg, wherein the parallel leg and the secondary parallel leg are each oriented parallel to a filter axis, and wherein the secondary parallel leg consists of a rectangular shaped leg; and a means for adjusting an impedance of the conductive trace pattern.

14. The tunable bandpass filter of claim 13, wherein the means for adjusting the impedance of the conductive trace pattern comprises:

at least one varactor diode coupled to a first T-shaped conductor portion of the series of T-shaped conductor portions and to the conductive ground plane; and bias control circuitry coupled to the first T-shaped conductor portion, wherein the bias control circuitry is configured to apply a voltage to the at least one varactor diode.

15. The tunable bandpass filter of claim 13, wherein the means for adjusting the impedance of the conductive trace pattern comprises:

a first varactor diode coupled to a first T-shaped conductor portion of the T-shaped conductor portions and to the conductive ground plane;

a second varactor diode coupled to a second T-shaped conductor portion of the T-shaped conductor portions and to the conductive ground plane; and bias control circuitry coupled to the first T-shaped conductor portion and the second T-shaped conductor portion, wherein the bias control circuitry is configured to independently control a first voltage provided to the first varactor diode and a second voltage provided to the second varactor diode.

16. The tunable bandpass filter of claim 13, wherein the T-shaped conductor portions each comprise:

a parallel leg oriented parallel to a filter axis; and a transverse stub having a first end coupled to the T-shaped conductor primary parallel leg, the T-shaped conductor transverse stub oriented perpendicular to the filter axis, wherein the T-shaped conductor transverse stub bisects the T-shaped conductor parallel leg.

17. The tunable bandpass filter of claim 13, wherein the at least one TL-shaped conductor portion comprises:

a first TL-shaped conductor portion positioned at an end of the conductive trace pattern and a second TL-shaped conductor portion, wherein a length of the secondary parallel leg of the first TL-shaped conductor portion is greater than a length of the secondary parallel leg of the second TL-shaped conductor portion.

18. The tunable bandpass filter of claim 13:

wherein the secondary parallel leg comprises a first end and a second end; and wherein the transverse stub abuts the secondary parallel leg at a point between the first end and the second end.

19. The tunable bandpass filter of claim 18, wherein the transverse stub comprises a first end terminating at the parallel leg and a second end terminating at the secondary parallel leg.

20. The tunable bandpass filter of claim 1:

wherein the secondary parallel leg comprises a first end and a second end; and wherein the transverse stub abuts the secondary parallel leg at a point between the first end and the second end.

21. The tunable bandpass filter of claim 20, wherein the transverse stub comprises a first end terminating at the parallel leg and a second end terminating at the secondary parallel leg.

* * * * *